United States Patent [19]

Ghorbani et al.

[11] Patent Number: 4,702,712

[45] Date of Patent: Oct. 27, 1987

[54] KEYED INSULATOR APPARATUS

[75] Inventors: Ali Ghorbani; Gary M. Walker, both of Richardson, Tex.

[73] Assignee: Rockwell International Corporation, El Segundo, Calif.

[21] Appl. No.: 922,649

[22] Filed: Oct. 24, 1986

[51] Int. Cl.[4] ..... H01R 13/40

[52] U.S. Cl. ..... 439/596; 439/586

[58] Field of Search ..... 339/59 R, 59 M, 61 R, 339/61 C, 61 M, 75 R, 75 M, 186 R, 186 M, 217 PS, 217 S

[56] References Cited

U.S. PATENT DOCUMENTS

| | | | |
|---|---|---|---|
| 3,332,053 | 7/1967 | Busler | 339/59 R |
| 3,994,555 | 11/1976 | Konno et al. | 339/59 R |
| 4,114,971 | 9/1978 | Heimbrock | 339/59 R |
| 4,253,718 | 3/1981 | Bungo | 339/59 R |
| 4,407,558 | 10/1983 | Thrift | 339/186 R |
| 4,607,903 | 8/1986 | Hoshino et al. | 339/59 R |

FOREIGN PATENT DOCUMENTS

| | | | |
|---|---|---|---|
| 2027288 | 2/1980 | United Kingdom | 339/59 R |

*Primary Examiner*—Gil Weidenfeld
*Assistant Examiner*—Paula A. Austin
*Attorney, Agent, or Firm*—Bruce C. Lutz; V. L. Sewell; H. Fredrick Hamann

[57] ABSTRACT

A device is disclosed for insulating and keying quick disconnect connectors. The device is wrapped around the quick disconnect connection with the wire already crimped in the quick disconnect connection and snaps on securely. It provides a multicombination key which prevents the insertion of a keyed insulator in the inappropriate mating connector slot.

3 Claims, 3 Drawing Figures

KEYED INSULATOR APPARATUS

THE INVENTION

The present invention is concerned generally with electric wiring, and more specifically, with keyed insulators for said wiring. Even more specifically, it's concerned with having an easily detachable unitary structure keyed insulator, that can be molded as a single piece, for use where keying of electrical connectors is desirable to prevent circuit damage while being economical to produce.

BACKGROUND

Quick disconnect products are commercially available where an insulator is molded over a metal electrical quick disconnect of either the male or female variety. Other quick disconnects are available where the electrical insulator is made of a heat shrink type material and again are not removable from the electrical quick disconnect. In both cases, the flammability rating is relatively low. Also, in each case the prior art keyed devices are designed such that a different key must be purchased for each different geometrically shaped part. Since these prior art devices are sold as a combination unit, visual inspection of the electrical wire connection (crimp) to the quick disconnect part and contacts is substantially impossible.

The present invention overcomes many of the defects of the prior art by providing a removable insulator. In view of the removability, there can be an adequate inspection of the electrical wire connection to the quick disconnect portion and the basic part may be designed in such a way that a given manufactured part can be easily field modified to be used in any of several keyed configurations.

It is thus an object of the present invention to provide an improved keyed electrical insulator.

Other objects and advantages of the present invention may be ascertained from a reading of the specification and appended claims in conjunction with the drawings, wherein:

DETAILED DESCRIPTION

Figure 1:
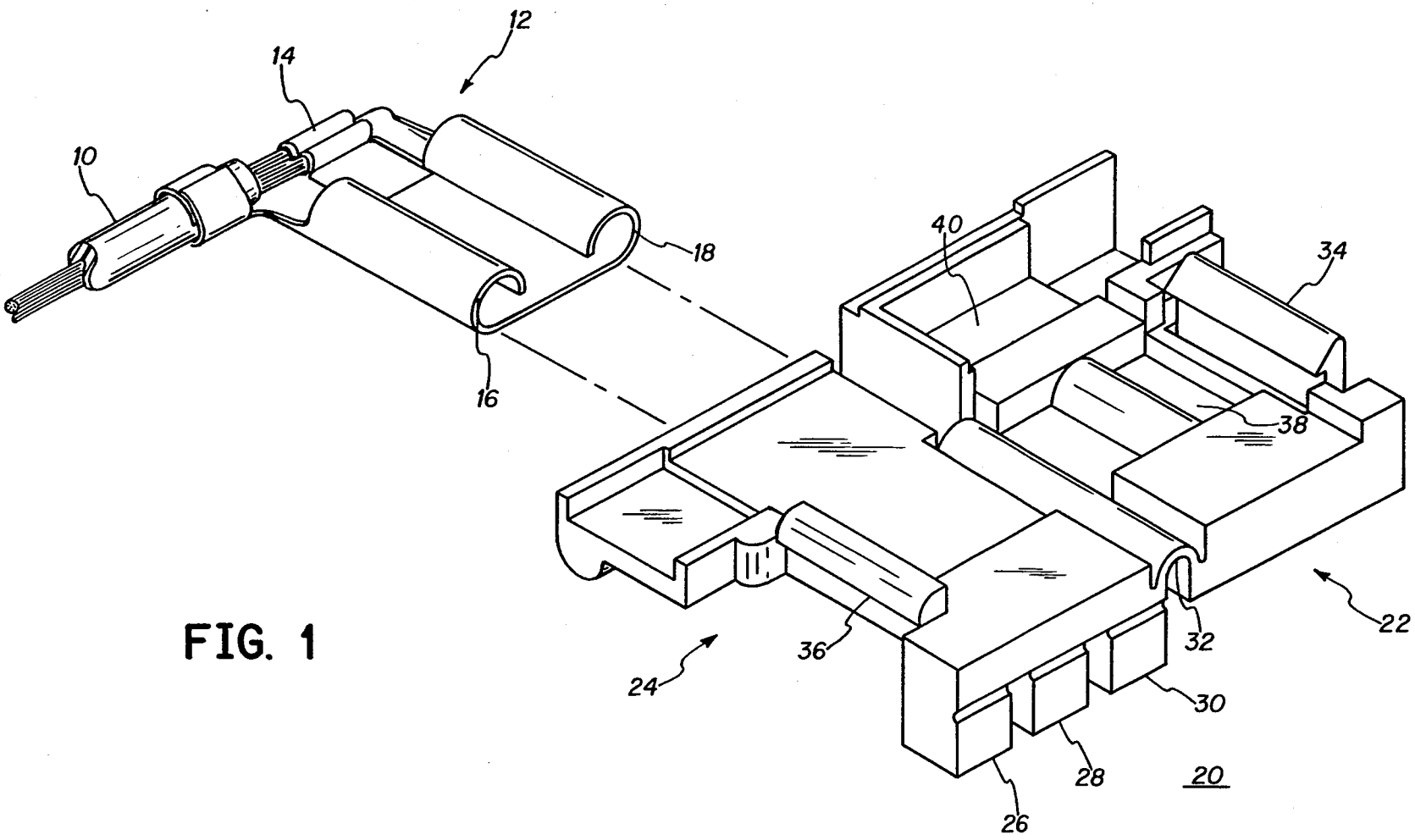
FIG. 1 is an isometric view of a preferred embodiment of the inventive concept insulator along with a right angle disconnect to be used therein.

In FIG. 1, an electrical wire designated as 10 is crimped into place in a right angle female quick disconnect connector, generally designated as 12 by the crimping portions 14. Quick disconnect connector 12 also has spring type contacts 16 and 18, which facilitate a good electrical contact with a male quick disconnect mating portion. A keyed insulator, generally designated as 20, is shown below the connector 12 and comprises a top portion 22, a bottom portion 24, keyed projections 26, 28 and 30, a hinge means 32, a latch 34 and a catch 36. Within top portion 22 are various indentations or recesses such as recess designated as 38 for accommodating one of the friction type contacts such as 16 and further recesses such as 40 for accommodating the electrical wire crimp portions designated as 14. The bottom portion 24 includes similar recesses so that the quick disconnect connector is properly positioned and maintained in position during the connect or disconnect action with a mating electrical connector.

Figure 2:
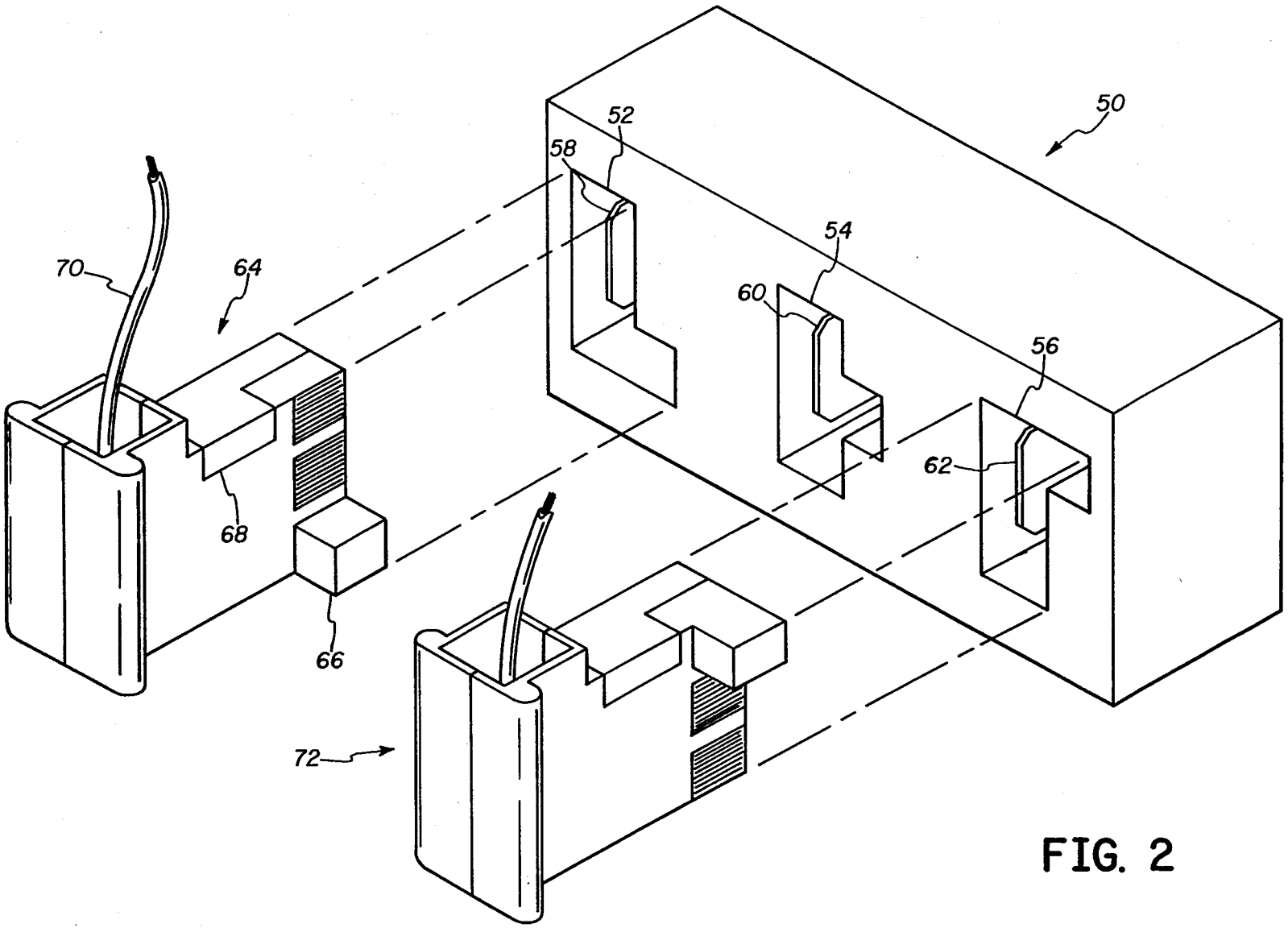
FIG. 2 is an isometric view of a connector block and two keyed insulators to be used therewith.

In FIG. 2, a connector block generally designated as 50 contains several openings 52, 54 and 56. Within each of the openings is illustrated a male quick disconnect electrical connector, such as 58, 60 and 62. As will be noted, the openings 52 and 56 are L-shaped with the opening 56 being an upside down L while the opening 54 is T-shaped. An insulator constructed according to the teachings of the present invention is generally designated as 64, and retains only a projection 66, since the projections corresponding to as 26 and 28 of FIG. 1 have been removed by a cutting tool so as to key this connector to fit only within opening 52. As will be noted, other details of insulator 64 comprise a latch portion 68, and an opening through which passes the wire 70 which is connected to the quick disconnect connector contained inside insulator 64. A similar insulator is illustrated as 72, and has the projections corresponding to projections 28 and 30 of FIG. 1 removed, so that it will fit in the upside down L opening 56.

Figure 3:
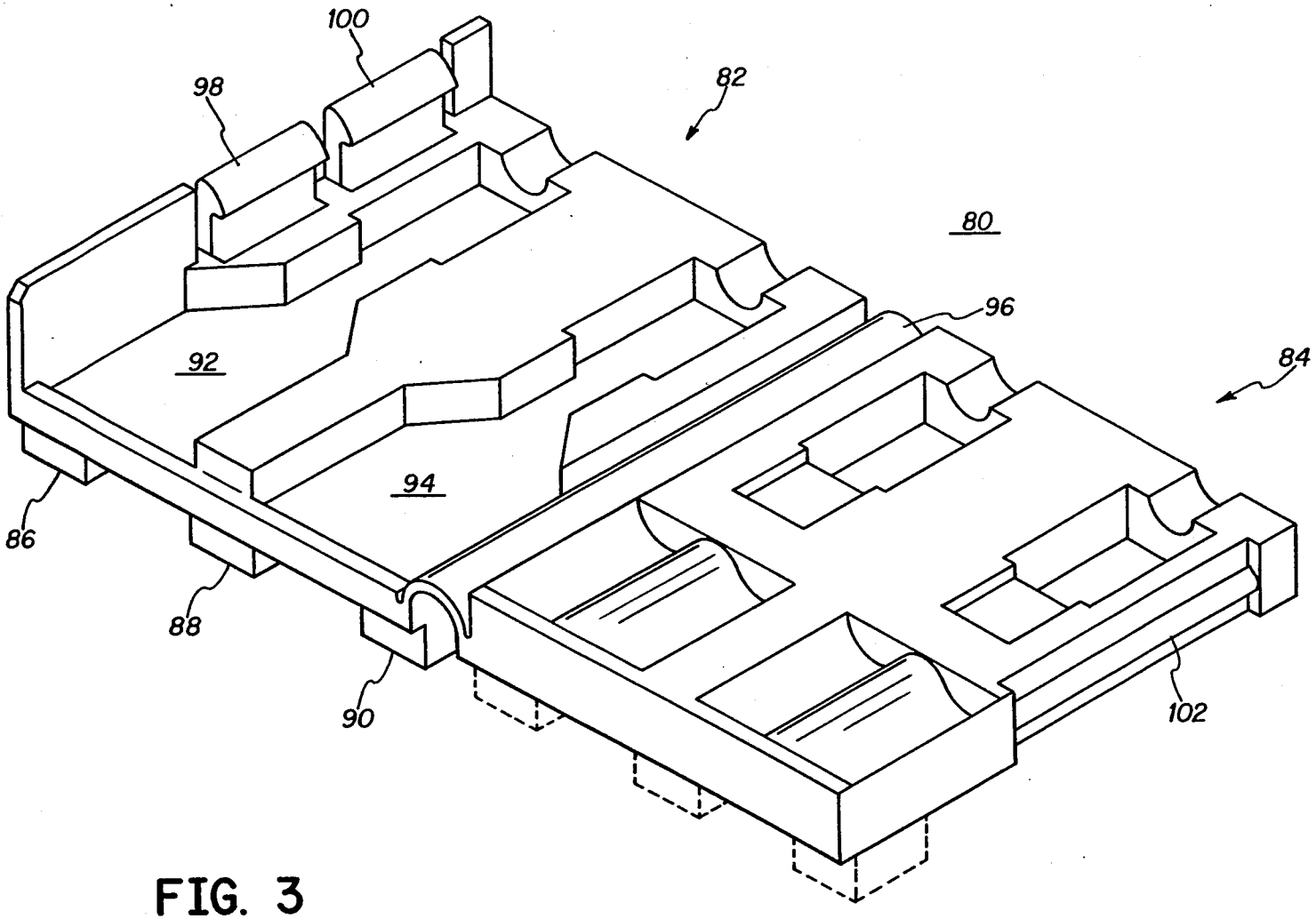
FIG. 3 is an isometric view of an insulator according to the present inventive concepts for use with two straight through electrical disconnects.

In FIG. 3, an insulating device is illustrated and generally designated as 80, having a bottom portion 82 and a top portion 84 along with projections 86, 88 and 90. Within the bottom portion 82 are recessed areas 92 and 94 for enclosing two straight through quick disconnect connectors as opposed to the right angle connector illustrated in FIG. 1. Additionally, hinge means 96 and latch means 98 and 100 are illustrated with a single catch means 102 coacting with the two latch means 98 and 100 which are designed as shown to provide added latch strength and safety.

The top portion 84 of insulating device 80 contains three dash line projections, which are not given numerical designations, to illustrate that the number of unique keying positions can be drastically increased by having projections on both the top and bottom portions of the insulator device.

OPERATION

The operation of the inventive concept is believed obvious in that the quick disconnect connector, such as 12, after it has been crimped onto a wire such as 10, is inserted into the bottom portion 24 and the top portion 22 is folded over so that there is an engagement of the latch 34 with the catch 36. The various cavities, such as 38 and 40, will coact with the appropriate protrusions on the quick disconnect connector 12 to properly position same within the device 20, and hold it in place for coaction with a male quick disconnect terminal such as 58. The device is then inserted into the proper keyed slot in accordance with the position of the projections, such as 26 through 30, that are removed from the overall device 20. The hinge means 32 will be bowed when the device is open in its position shown in FIG. 1, and depending upon the design may be either unbowed or only substantially unbowed when it's in the closed position as shown in FIG. 2.

If more keyed combinations are required, the projections can be designed on both halves of the insulator as shown in FIG. 3. Although three projections have combinations such that there are more than three unique combinations, only three of these combinations can be utilized in a keyed arrangement such that no other key can be improperly inserted into the receptacle for that combination. However, when a design similar to that shown in FIG. 3 is used with projections on both sides, six projections can produce more than six different unique combinations that will still prevent the accidental insertion of the insulator in a given receptacle.

No further explanation is believed required for FIG. 3 which is merely a further embodiment for use with straight through quick disconnect connectors.

The concept may be used for either male or female quick disconnect connectors. One embodiment of this concept used flame retardant plastic.

To reuse the connector, the latch 34 can be pried sideways to release it from the catch 36, and the insulator can be opened for further visual inspection of the quick disconnect connector, or to use same on a different connector.

While two embodiments of the inventive concept have been illustrated, we wish to be limited not by the invention as shown in the drawings or as discussed above, but only by the scope of the appended claims, wherein we claim:

1. Unitary keyed electrical terminal insulator apparatus comprising, in combination:

top portion means including first and second surfaces where said first surface includes cavities for accommodating at least one quick disconnect electrical terminal means having an electrical wire portion and a quick disconnect mating portion;

bottom portion means including first and second surfaces where said first surfaces includes cavities for accommodating said at least one quick disconnect electrical terminal means;

flexible hinge means interconnecting said top and bottom portions whereby said top and bottom portions may be side by side in manufacture with said hinge means being bowed;

latch means on an edge of one of said top and bottom portions;

catch means on an edge of the other of said top and bottom portions for coacting with said latch means;

a plurality of removable projecting keying means extending from said second surface of at least one of said top and bottom portions as manufactured and at least one of said removable projecting keying means being removed for each of several keyed configurations, and said top portion means, bottom portion means, latch means, catch means, hinge means and keying means all comprising a unitary structure of one material.

2. Reusable keyed electrical terminal insulator apparatus comprising, in combination:

a top portion including interior and exterior surfaces where the interior surfaces includes cavities for accommodating at least one quick disconnect electrical terminal means having an electrical wire portion and a quick disconnect mating portion;

a bottom portion including interior and exterior surfaces where said interior surfaces includes cavities for accommodating said at least one quick disconnect electrical terminal means;

integrated hinge means interconnecting said top and bottom portions whereby said top and bottom portions may be side by side in manufacture and for assembly of electrical terminal means to be enclosed with said hinge means being bowed and whereby said top and bottom portions are one on top of the other when the electrical terminal means is enclosed with said hinge means being substantially unbowed;

latch means on an edge of one of said top and bottom portions;

catch means on an edge of the other of said top and bottom portions for coacting with said latch means; and removable keying means comprising a plurality of projections extending from and removable from said exterior surface of at least one of said top and bottom portions near where the quick disconnect mating portion of the electrical terminal means would be, at least one of said removable projecting keying means being removed for each of several keyed configurations, said top portion, bottom portion, latch means, catch means, hinge means and keying means all comprising a unitary structure of one material.

3. Electrical terminal insulator apparatus comprising, in combination:

a top portion including a first surface having cavities for accommodating at least one quick disconnect electrical terminal means having an electrical wire portion and a quick disconnect mating portion and including a second surface;

a bottom portion including a first surface having cavities for accommodating said at least one quick disconnect electrical terminal means having an electrical wire portion and a quick disconnect mating portion mentioned previously and including a second surface;

integrated hinge means interconnecting said top and bottom portions whereby said top and bottom portions may be side-by-side in manufacture and for assembly of electrical terminal means to be enclosed with said hinge means being bowed and whereby the top and bottom portions are one on top of the other when the electrical terminal means is enclosed with said hinge means being substantially unbowed;

flexible latch means on an edge of one of said top and bottom portions opposite said hinge means;

catch means on an edge of the other of said top and bottom portions for coacting with said latch means opposite said hinge means; and removable keying means projecting from and removable from said second surface of at least one of said top and bottom portions, as manufactured, near where the quick disconnect mating portion of said electrical terminal means would be, at least one of said removable projecting keying means being removed for each of several keyed configurations, said top portion, bottom portion, latch means, catch means, hinge means and keying means all comprising a unitary structure of one material.

* * * * *